US007337494B2

(12) United States Patent
Baer et al.

(10) Patent No.: US 7,337,494 B2
(45) Date of Patent: Mar. 4, 2008

(54) ELECTROSTATIC CLOTH ATTACHMENT FOR VACUUM HEAD

(75) Inventors: Mark Baer, Trout Run, PA (US); Robert L. Crevling, Jr., Cogan Station, PA (US); Cory F. Girton, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 424 days.

(21) Appl. No.: 10/854,011

(22) Filed: May 26, 2004

(65) Prior Publication Data

US 2005/0262661 A1 Dec. 1, 2005

(51) Int. Cl.
*A47L 9/06* (2006.01)

(52) U.S. Cl. ..... 15/403; 15/246.2; 15/415.1

(58) Field of Classification Search ..... 15/403, 15/246.2, 415.1, 416; *A47L 9/02*
See application file for complete search history.

(56) References Cited

U.S. PATENT DOCUMENTS 6,966,098 B2 * 11/2005 Sako et al. ..... 15/403
7,013,528 B2 * 3/2006 Parker et al. ..... 15/403
7,137,169 B2 * 11/2006 Murphy et al. ..... 15/403
2005/0076468 A1 * 4/2005 Matousek et al. ..... 15/403

FOREIGN PATENT DOCUMENTS

| | | | |
|---|---|---|---|
| EP | 1027855 | * | 8/2000 |
| JP | 09-038011 | * | 2/1997 |
| JP | 10-14829 | * | 1/1998 |
| KR | 2001104041 | * | 11/2001 |

* cited by examiner

*Primary Examiner*—Theresa T. Snider
(74) *Attorney, Agent, or Firm*—Marshall, Gerstein & Borun LLP

(57) ABSTRACT

A vacuum head assembly is disclosed which includes a vacuum head detachably connected to a secondary head, which is designed to carry an electrostatic cloth. The secondary head assumes a horizontal position behind the vacuum head so that the scoop of the vacuum head moves across the surface to be cleaned first followed by the secondary head, equipped with the electrostatic cloth. The cloth thus engages the floor after the scoop of the vacuum head. The secondary head carrying the electrostatic cloth may be easily connected to and disconnected from the vacuum head thereby rendering the vacuum head suitable for both hard and soft (i.e., carpeted) surfaces.

13 Claims, 7 Drawing Sheets

ELECTROSTATIC CLOTH ATTACHMENT FOR VACUUM HEAD

TECHNICAL FIELD

An improved vacuum cleaner head is disclosed. More specifically, a detachable electrostatic cloth head is provided which may be easily mounted to the vacuum cleaner head and easily disconnected when desired.

BACKGROUND OF THE RELATED ART

Vacuum cleaner heads equipped with electrostatic cloth attachments are known. Specifically, an additional head or plate is typically mounted parallel to the vacuum cleaner head along a rear side thereof. The head or plate, which is generally parallel to the suction inlet of the vacuum cleaner head and in a horizontal position, is designed to detachably receive an electrostatic cloth, which may be replaced when dirty. Thus, as the vacuum cleaner head and cloth are moved along the floor, any dust or particles not drawn up into the vacuum cleaner head under the force of the vacuum, may be picked up by the electrostatic cloth. The combination of the electrostatic cloth and the vacuum head provides an effective cleaning tandem for hard surfaces such as hardwood, tile and vinyl floors.

However, the addition of the electrostatic cloth head equipped renders the combination of the vacuum cleaner head and electrostatic cloth head bulky in size. Thus, with the two heads in place, it is often difficult to maneuver the combination into corners and small areas during a cleaning operation. Often, consumers desire to use only the vacuum cleaner head, without the electrostatic cloth head, to clean, small, confined spaces.

Further, consumers also like to have the option of using the vacuum cleaner head, without the electrostatic cloth head, particularly when the consumer has run out of clean electrostatic cloths or if the consumer desires to use the vacuum cleaner on a carpeted or upholstered surface, where the electrostatic cloths are not effective. The combination of the electrostatic cloth and vacuum cleaner head is only effective on hard surfaces, such as hard floors, or tiled floors.

Therefore, there is a need for an improved vacuum cleaner head assembly which provides the benefits of combining a vacuum cleaner head with an electrostatic cloth head but which also enables the consumer to easily detach or disconnect the electrostatic cloth head from the vacuum cleaner head when cleaning small, confined spaces or when moving from a hard surface to a carpeted or upholstered surface.

SUMMARY OF THE DISCLOSURE

In satisfaction of the aforenoted needs, an improved vacuum cleaner head assembly is disclosed. The improved head assembly comprises a vacuum head comprising a front side and a rear side with the rear side of the vacuum head further comprising a pair of spaced apart brackets. The assembly further comprises a secondary head for accommodating a cloth. The secondary head also comprises a pair of spaced apart brackets. The vacuum head brackets and secondary head brackets are detachably connectable together.

In a refinement, the brackets of the vacuum and secondary heads are detachably connected by a tongue-in-groove connection.

In a refinement, the assembly further comprises a pair of latches to secure the secondary head brackets to the vacuum head brackets when the secondary head bracket are connected to the vacuum head brackets.

In a further refinement of this concept, one latch is connected to one of the secondary head brackets and the other latch is connected to the other of the secondary head brackets and the latches are flexibly biased into engagement with one of the vacuum head brackets when the tongues are received in the grooves.

In a further refinement, one latch is connected to one of the vacuum head brackets and the other latch is connected to the other of the vacuum head brackets and the latches are flexibly biased into engagement with one of the secondary head brackets when the tongues are received in the grooves.

In a refinement, the vacuum head brackets are connected to the vacuum head with a suction hose port disposed therebetween.

In a refinement, the tongue-in-groove connection comprises each vacuum head bracket comprising a groove and each secondary head bracket comprising a tongue, the secondary head brackets being configured so the tongue of one of the secondary head brackets can be slidably received in the groove of one of the vacuum head brackets and the tongue of the other secondary head bracket can be slidably received in the groove of the other vacuum head bracket.

In a refinement, the tongue-in-groove connection comprises each vacuum head bracket comprising a tongue and each secondary head bracket comprising a groove, the secondary head brackets being configured so the groove of one of the secondary head brackets slidably receives the tongue of one of the vacuum head brackets and the groove of the other secondary head bracket slidably receives the tongue of the other vacuum head bracket.

In a refinement, the cloth is an electrostatic cloth.

In another refinement, a disclosed vacuum cleaner head assembly comprises a vacuum head comprising a front side and a rear side connected to a suction hose port. The rear side of the vacuum head further comprises a pair of spaced apart brackets. The assembly further comprises a secondary head for accommodating a cloth. The secondary head comprises a pair of spaced apart brackets. The vacuum head brackets and secondary head brackets are detachably connectable by a tongue-in-groove connection. The assembly further comprises a pair of latches to secure the secondary head brackets to the vacuum head brackets when the secondary head bracket are connected to the vacuum head brackets by the tongue-in-groove connection.

In another refinement, a disclosed vacuum cleaner head assembly comprises a vacuum connected to a suction hose port. The rear side of the vacuum head further comprising a pair of brackets spaced apart and connected to the rear side of the vacuum head on either side of the suction hose port. Each vacuum head bracket comprising a slot. The assembly further comprises a secondary head for accommodating an electrostatic cloth. The secondary head also comprises a pair of spaced apart brackets. Each bracket of the secondary head comprises a tongue. The brackets of the secondary head is configured so the tongue of one of the secondary head brackets can be slidably received in the slot of one of the vacuum head brackets and the tongue of the other secondary head bracket can be slidably received in the slot of the other vacuum head bracket. The secondary head brackets each further comprise a latch to secure the secondary head brackets to the vacuum head brackets when the tongues of the secondary head bracket are received in the slots of the vacuum head brackets.

BRIEF DESCRIPTION OF THE DRAWINGS

The disclosed embodiments are disclosed more or less diagrammatically in the accompanying drawings, wherein.

Figure 1:
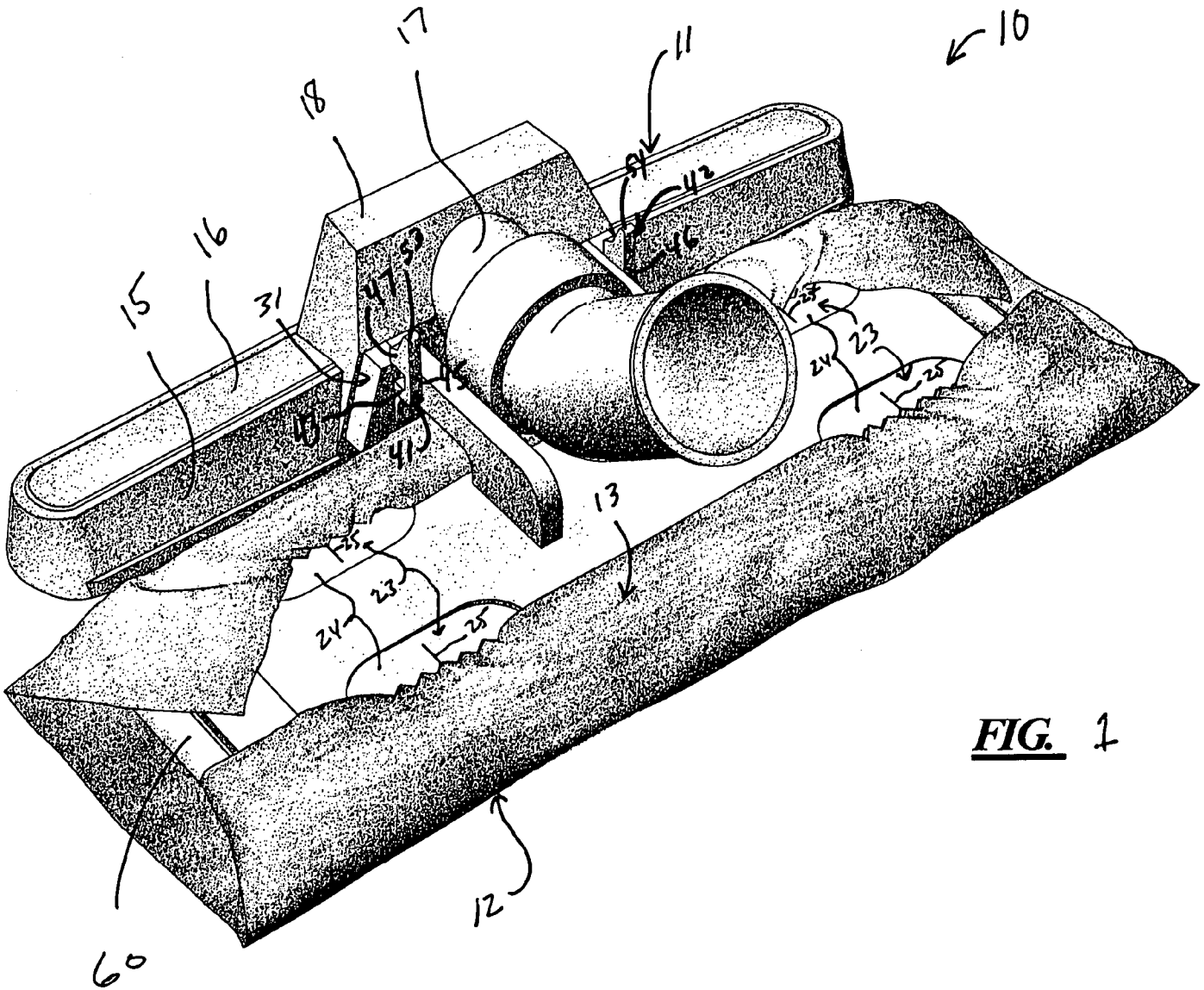
FIG. 1 is a rear perspective view of a vacuum cleaner head assembly made in accordance with this disclosure.
Figure 2:
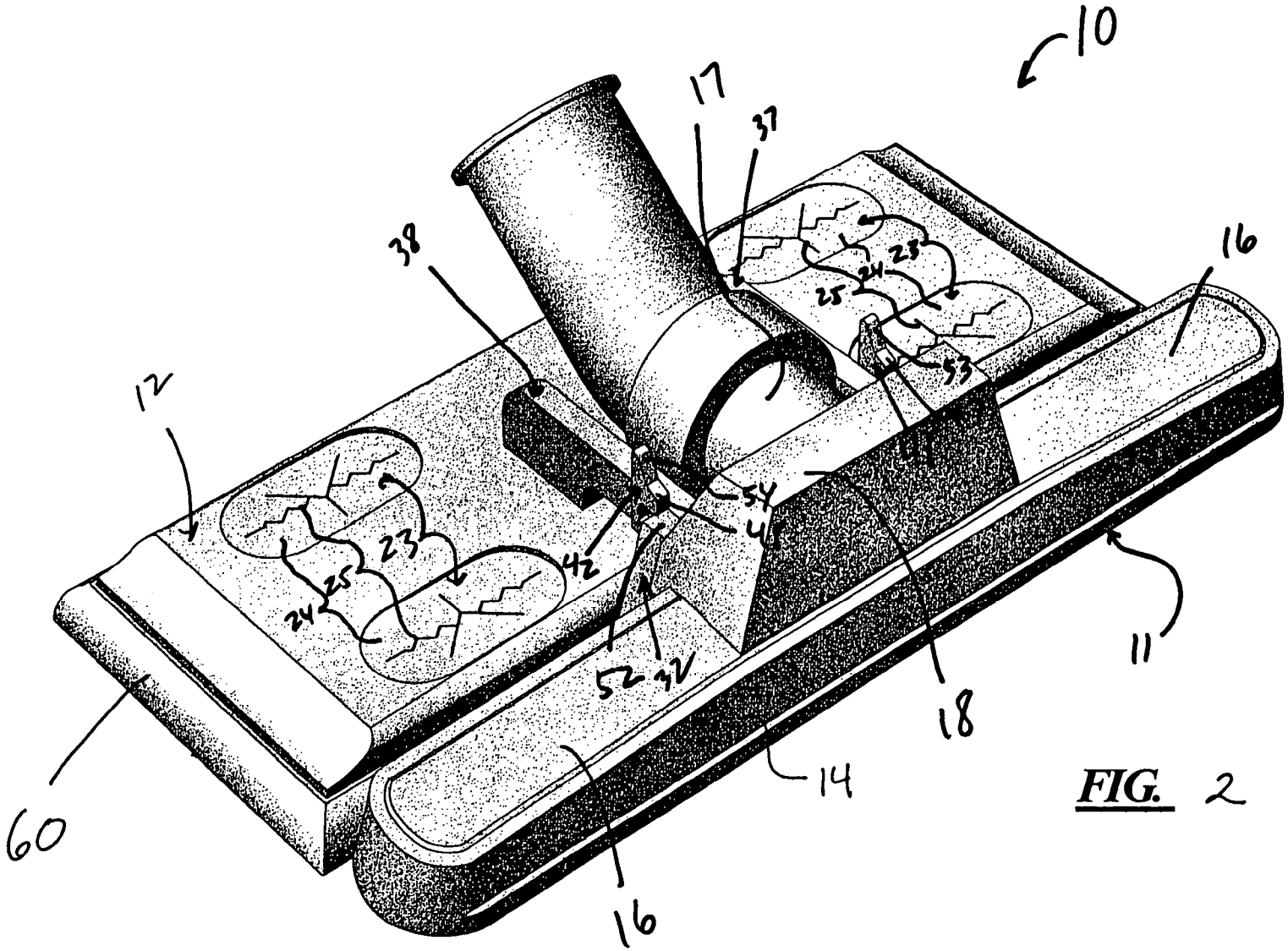
FIG. 2 is a front perspective view of the vacuum cleaner head assembly shown in FIG. 1, without the electrostatic cloth attached thereto.

It should be understood that the drawings are not necessarily to scale and that the embodiments have been illustrated with diagrammatic representations and fragmentary views. In certain instances, details which are not necessary for an understanding of the disclosed embodiments or which render other details difficult to perceive may have been omitted. It should be understood that this disclosure is not necessarily limited to the particular embodiments illustrated herein.

DETAILED DESCRIPTION OF THE PRESENTLY PREFERRED EMBODIMENTS

FIGS. 1-4 illustrate a vacuum cleaner head assembly 10 which includes a vacuum head 11 detachably connected to a secondary head 12 which, in the embodiment disclosed in FIGS. 1-4, provides support for a cloth 13 and, more specifically, an electrostatic cloth 13. FIGS. 5-8 illustrate a slightly different embodiment of a vacuum head assembly 10*a* using the same reference numerals used for the elements illustrated in FIGS. 1-4 but with the subscript "a."

The vacuum head 11 includes a front side 14 that is connected to a rear side 15 by a top panel 16, all of which define a downwardly facing scoop for the collection of debris. The rear side 15 of the vacuum head 11 is connected to a suction hose port 17. In the embodiment shown in FIGS. 1-4, the rear side 15 and top panel 16 of the vacuum head 11 includes a hollow upper extension 18 which, in turn, is connected to the suction hose port 17. The suction hose port 17 is then connected to a vacuum hose (not shown) which is connected to a vacuum pump (not shown).

The secondary head 12 comprises a generally flat structure with a horizontal bottom side 21 that faces the floor and a generally horizontal top side 22. The top side 22 comprises a plurality of sockets shown at 23 which, in turn, each comprise a membrane 24 with one or more slits or cuts 25 disposed therein. The slits or cuts 25 in the flexible membrane 24 can releasably accommodate a side edge or other portion of the cloth 13 as shown in FIG. 1. All the consumer needs to do is simply press an edge portion of the cloth 13 through the slit 25 of the membrane 24 of each socket 23 to secure the cloth in place as shown in FIG. 1.

A key advantage of the embodiment 10 shown in FIGS. 1-4 (and the embodiment 10*a* of FIGS. 5-8) is that the secondary heads 12, 12*a* are easily detached from the vacuum heads 11, respectively.

Figure 3:
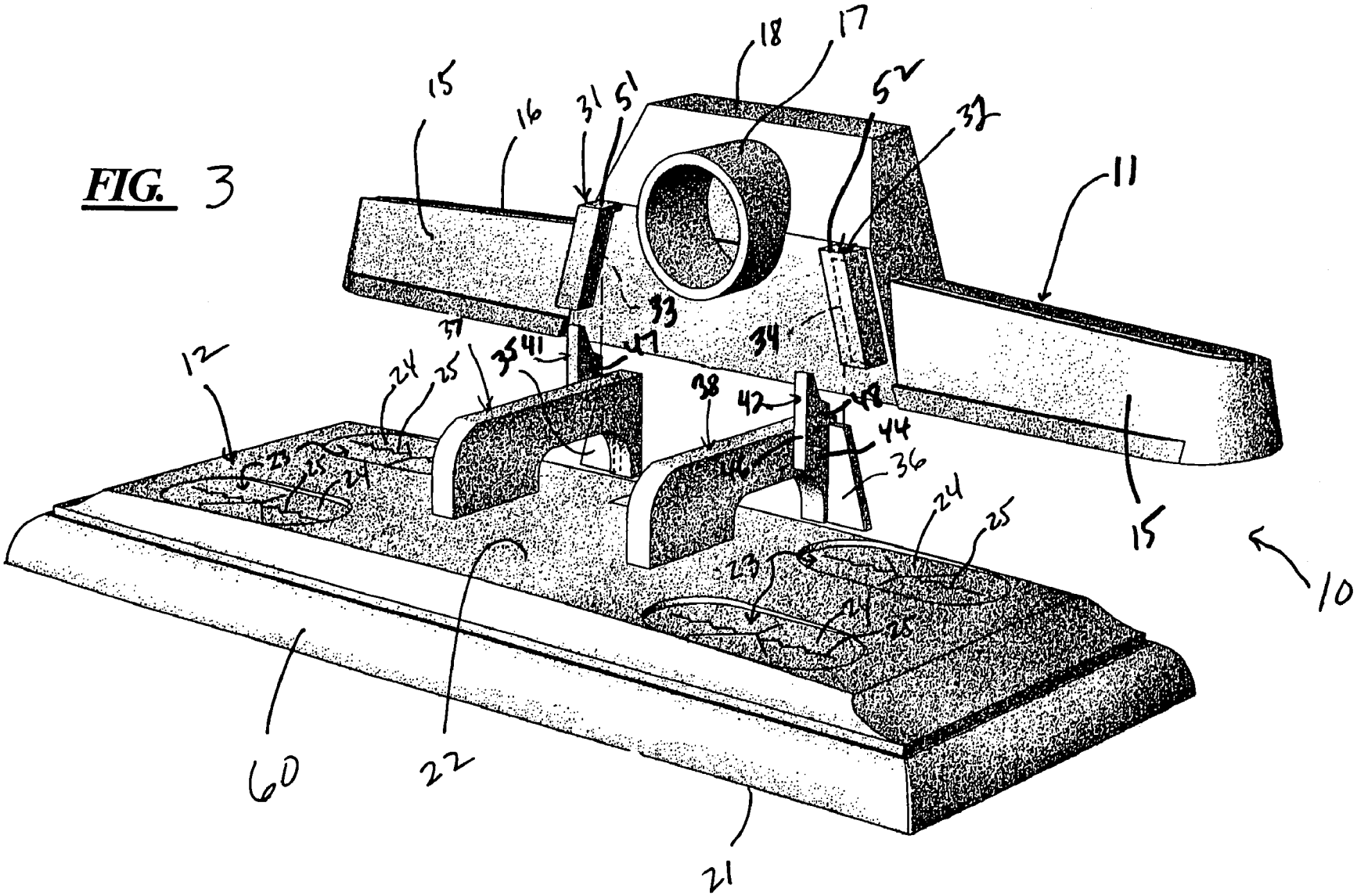
FIG. 3 is a rear exploded perspective view of the vacuum cleaner head assembly as shown in FIG. 2.

Specifically, as best seen in FIG. 3, the vacuum head 11 comprises a pair of space-apart brackets 31, 32. Each bracket 31, 32 includes a slot or groove 33, 34. Each slot or groove 33, 34 is aligned and shaped to receive a corresponding tongue 35, 36 attached to the brackets 37, 38 of the secondary head 12.

From the lower position shown in FIG. 3 (see also FIG. 7 for the embodiment 10*a*), the user aligns the brackets 37, 38 of the secondary head 12 with the brackets 31, 32 of the vacuum head 11. Then, the user moves the heads 11, 12 together so that the tongues 35, 36 are received in the corresponding slots or grooves 33, 34 of the brackets 31, 32 so that the assembly 10 assumes the position shown in FIGS. 1, 2 and 4.

Figure 4:
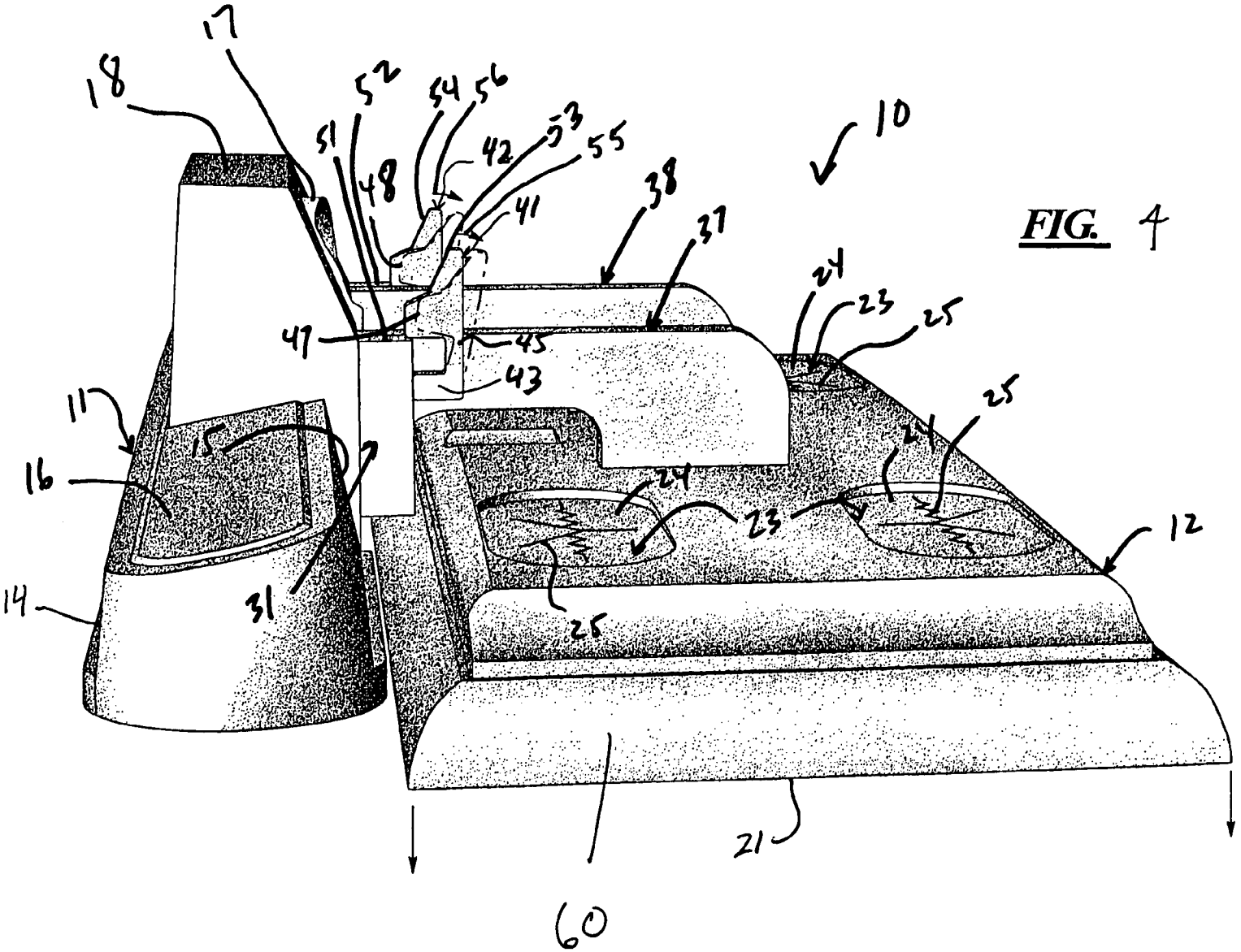
FIG. 4 is a side perspective view of the vacuum cleaner head assembly as shown in FIGS. 2-3.
Figure 5:
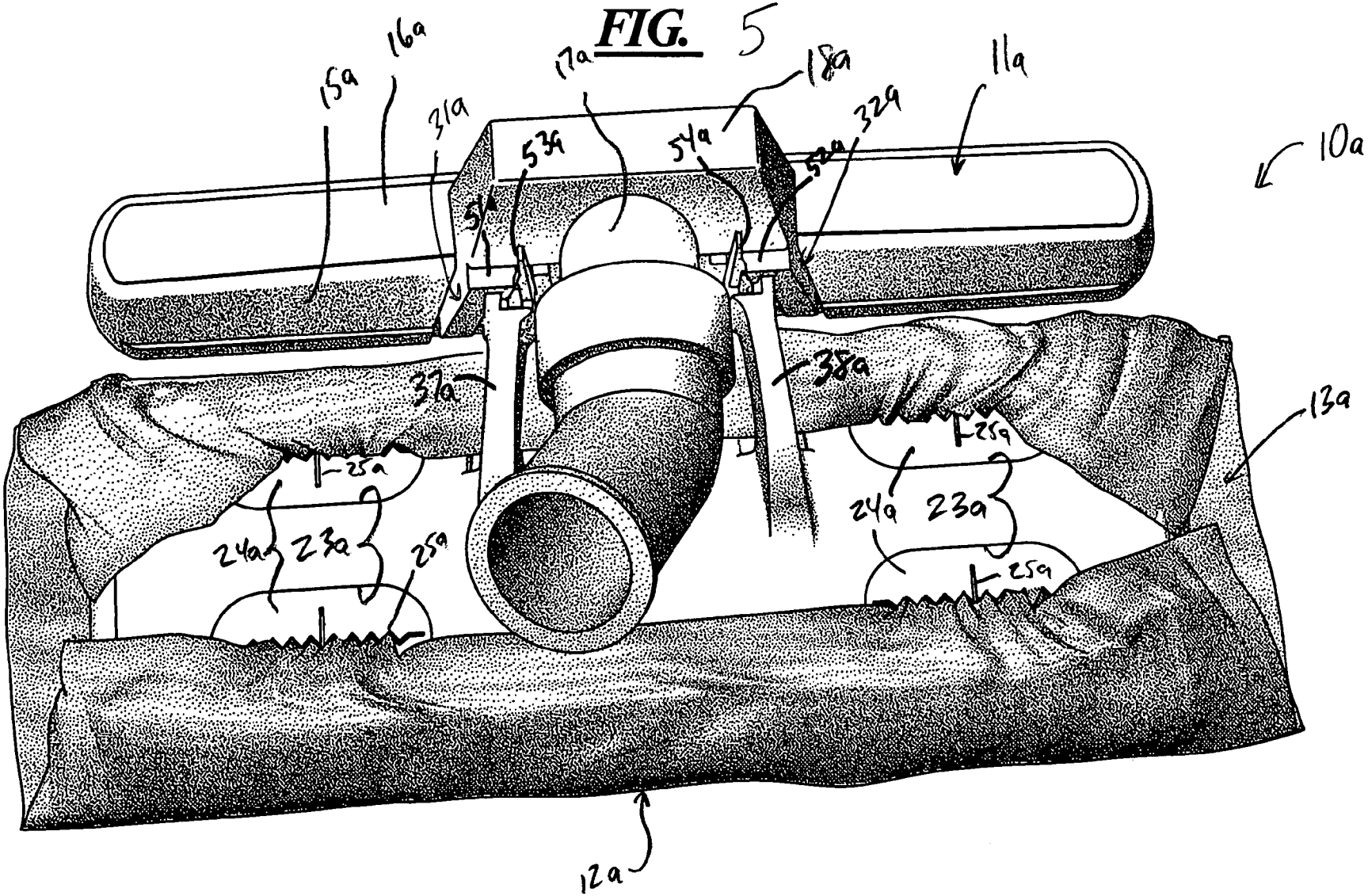
FIG. 5 is a rear perspective view of a second embodiment of a vacuum cleaner head assembly made in accordance with this disclosure.
Figure 6:
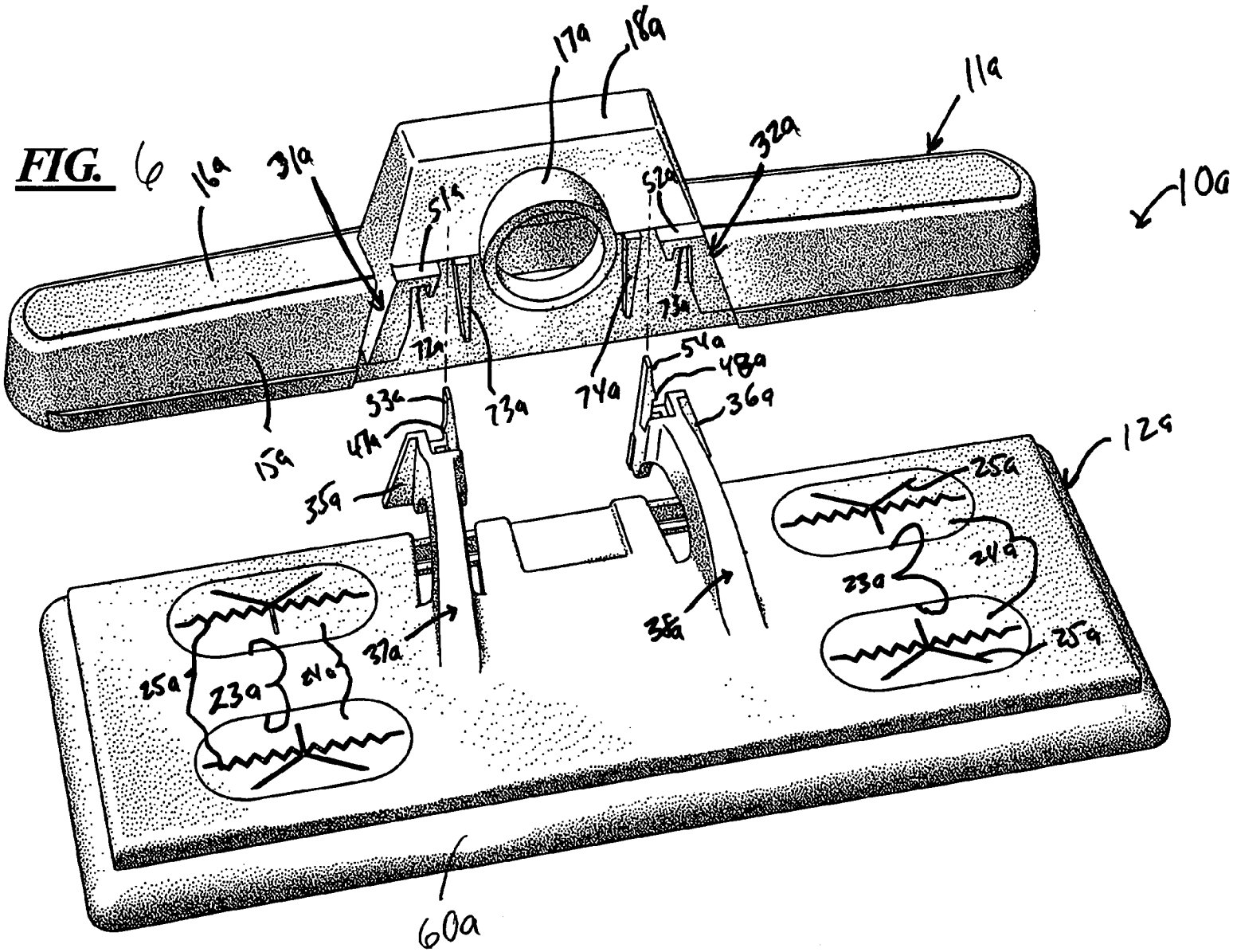
FIG. 6 is a rear exploded perspective view of the vacuum cleaner head assembly shown in FIG. 5.

The brackets 37, 38 of the secondary head 12 are also equipped with flexible latches 41, 42. Each latch 41, 42 includes a lower leg 43, 44 that is connected to its corresponding bracket 37, 38 of the secondary head 12. Each lower leg 43, 44 is connected to an upwardly extending leg 45, 46 which, in turn, is connected to a forwardly extending leg 47, 48 which provides a gripping latching mechanism over the top surface 51, 52 of the corresponding bracket 31, 32 of the vacuum head 11 as best shown in FIG. 4. Preferably, the latches 41, 42 are made from a flexible resilient material thereby eliminating the need for a pivotal attachment with a biasing mechanism, but such a more complicated structure could also be employed. An advantage of the structure illustrated in FIGS. 1-4 and 5-8 is that the brackets 37, 38, 37*a*, 38*a* of the secondary heads 12, 12*a* can be molded as a unitary part, and can also be molded with the main structure of the secondary heads 12, 12*a*. Further, the brackets 31, 32, 31*a*, 32*a* can be molded with the entire structure of the vacuum heads 11, 11*a* as shown.

An injection molding process is the preferred manufacturing technique for both the vacuum head 11 and the secondary head 12 although other alternative techniques will be apparent to those skilled in the art. One preferred material of construction is polypropylene, but certain polyethylenes can be used as well. Other suitable materials include polyvinylchloride, polyethyleneterepthalata, polycarbonate and mixtures thereof. Also, the secondary heads 12, 12*a* are preferably equipped with a molded pad 60, 60*a* that is separately molded from a softer material, such as a thermal plastic elastomer (TPE). Many TPEs are available and known to those skilled in the art.

Turning to FIG. 4, after the tongues 35, 36 are initially received in the slots or grooves 33, 34, the forward legs 47, 48 of the brackets 41, 42 will be biased rearwardly as the tongues 35, 36 are inserted farther into the grooves 33, 34 and, when the tongues 35, 36 are fully received in the grooves 33, 34, the latches 41, 42 will snap forward so that the forward legs 47, 48 will assume a position disposed on top of the upper surfaces 51, 52 of the brackets 31, 32 as shown in solid line in FIG. 4. To detach the secondary head 12 from the vacuum head 11, all the consumer needs to do is grab on to the finger tabs 53, 54 and pull backward in the direction of the arrows 55, 56 to release the legs 47, 48 from the upper surfaces 51, 52 of the brackets 31, 32 and thereafter push the secondary head downward or, in contrast, raise the vacuum head 11 upward, or a combination of the two movements.

Figure 7:
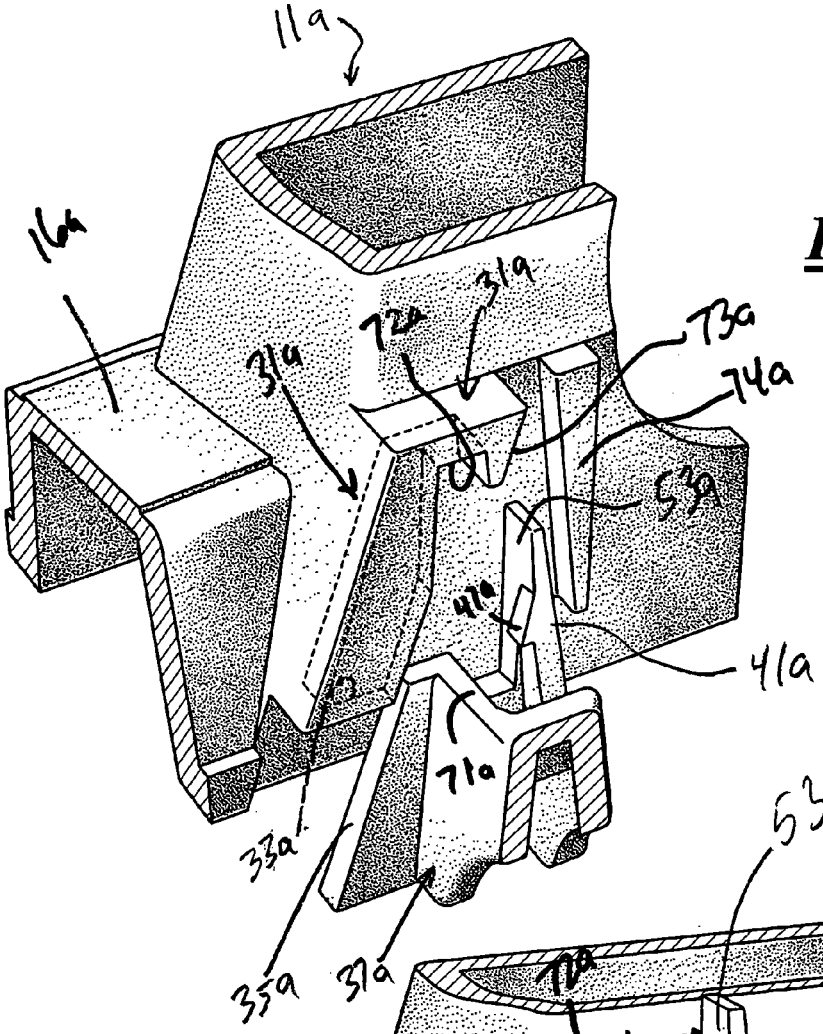
FIGS. 7 and 8 are partial perspective views illustrating the latching mechanism between the vacuum head and secondary head of the assembly shown in FIGS. 5 and 6.
Figure 8:
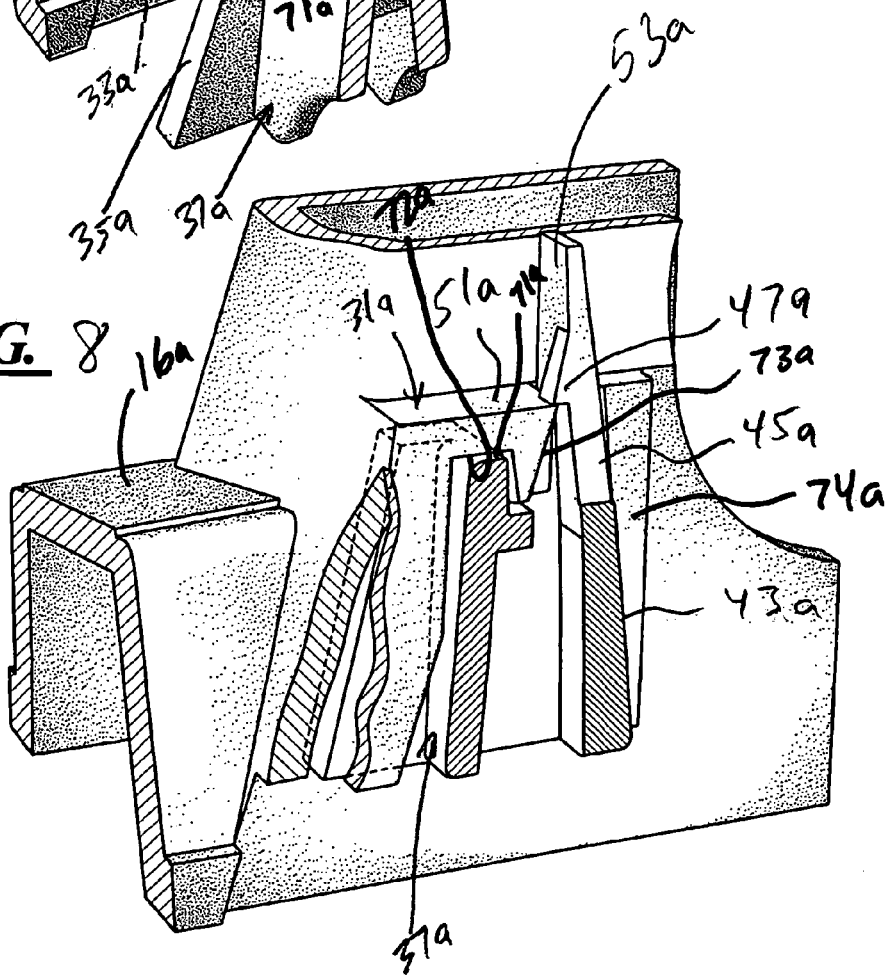

FIGS. 5-8 illustrate an additional embodiment 10*a* with revised brackets 31*a*, 32*a* on the vacuum cleaner head 11*a* and revised brackets 37*a*, 38*a* disposed on the secondary head 12*a*. Turning to FIGS. 7 and 8, and referring only to the left brackets 31*a*, 37*a*, the bracket 31*a* of the vacuum cleaner head 11*a* also includes a slot or groove shown in phantom at

33*a*. The bracket 37*a* of the secondary head 12*a* also includes a tongue 35*a* which is received within the groove 33*a*. A top wall 71*a* of the bracket 37*a* is received within the slot 72*a* of the bracket 31*a* as shown in FIG. 8. As this happens, the forwardly extending leg 47*a* rides up the ramped surface 73*a* of the bracket 31*a* until it reaches its latching mechanism as shown in FIG. 8. As an additional guide, a wedge shaped wall 74*a* is provided on the vacuum cleaner head 11*a* to facilitate the alignment of the brackets 37*a*, 38*a* of the secondary head 12*a* with the brackets 31*a*, 32*a* of the vacuum cleaner head 11*a*.

Thus, an improved vacuum head assembly 10 is provided whereby a secondary head 12 which carries an electrostatic cloth 13 may be easily connected to and disconnected from a vacuum head 11.

While only a single embodiment has been set forth and described, alternative embodiments and various modifications will apparent from the above description to those skilled in the art. These and other alternatives are considered equivalents in with the spirit and scope of this disclosure.

What is claimed is:

1. A vacuum cleaner that has:

a vacuum head with a front side and a rear side;

a pair of spaced apart brackets on the rear side of the vacuum head;

a secondary head that accommodates a cloth;

a pair of spaced apart brackets on the secondary head; and a tongue-in-groove connection that detachably connects the brackets on the vacuum head with the brackets on the secondary head.

2. A vacuum cleaner as recited in claim 1, in which the vacuum cleaner also has a pair of latches that secure the secondary head brackets to the vacuum head brackets when the secondary head brackets are connected to the vacuum head brackets by the tongue-in-groove connection.

3. A vacuum cleaner as recited in claim 1, in which the vacuum cleaner also has:

one latch that is connected to one of the secondary head brackets and is flexibly biased into engagement with one of the vacuum head brackets when the tongue-in-groove connection is connected; and another latch that is connected to the other of the secondary head brackets and is flexibly biased into engagement with one of the vacuum head brackets when the tongue-in-groove connection is connected.

4. A vacuum cleaner as recited in claim 1, in which the vacuum cleaner also has:

one latch that is connected to one of the vacuum head brackets and is flexibly biased into engagement with one of the vacuum head brackets when the tongue-in-groove connection is connected; and another latch that is connected to the other of the vacuum head brackets and is flexibly biased into engagement with one of the secondary head brackets when the tongue-in-groove connection is connected.

5. The vacuum cleaner of claim 1 in which the tongue-in-groove connection comprises each vacuum head bracket comprising a groove and each secondary head bracket comprising a tongue, the secondary head brackets being configured so the tongue of one of the secondary head brackets can be slidably received in the groove of one of the vacuum head brackets and the tongue of the other secondary head bracket can be slidably received in the groove of the other vacuum head bracket.

6. The vacuum cleaner of claim 1 in which the tongue-in-groove connection comprises each vacuum head bracket comprising a tongue and each secondary head bracket comprising a groove, the secondary head brackets being configured so the groove of one of the secondary head brackets slidably receives the tongue of one of the vacuum head brackets and the groove of the other secondary head bracket slidably receives the tongue of the other vacuum head bracket.

7. A vacuum cleaner head assembly comprising:

a vacuum head comprising a front side and a rear side connected to a suction hose port, the rear side of the vacuum head further comprising a pair of spaced apart brackets, the assembly further comprising a secondary head for accommodating a cloth, the secondary head comprising a pair of spaced apart brackets, the vacuum head brackets and secondary head brackets being detachably connectable by a tongue-in-groove connection, and the assembly further comprising a pair of latches to secure the secondary head brackets to the vacuum head brackets when the secondary head bracket are connected to the vacuum head brackets by the tongue-in-groove connection.

8. The assembly of claim 7 wherein the vacuum head brackets are connected to the vacuum head with the suction hose port disposed therebetween.

9. The assembly of claim 7 wherein the tongue-in-groove connection comprises each vacuum head bracket comprising a groove and each secondary head bracket comprising a tongue, the secondary head brackets being configured so the tongue of one of the secondary head brackets can be slidably received in the groove of one of the vacuum head brackets and the tongue of the other secondary head bracket can be slidably received in the groove of the other vacuum head bracket.

10. The assembly of claim 9 wherein one latch is connected to one of the secondary head brackets and the other latch is connected to the other of the secondary head brackets and each of the latches is flexibly biased into engagement with one of the vacuum head brackets when the tongues are received in the grooves.

11. The assembly of claim 7 wherein the tongue-in-groove connection comprises each vacuum head bracket comprising a tongue and each secondary head bracket comprising a groove, the secondary head brackets being configured so the groove of one of the secondary head brackets slidably receives the tongue of one of the vacuum head brackets and the groove of the other secondary head bracket slidably receives the tongue of the other vacuum head bracket.

12. The assembly of claim 11 wherein one latch is connected to one of the vacuum head brackets and the other latch is connected to the other of the vacuum head brackets and each of the latches is flexibly biased into engagement with one of the secondary head brackets when the tongues are received in the grooves.

13. A vacuum cleaner head assembly comprising:

a vacuum head comprising a front side and a rear side connected to a suction hose port, the rear side of the vacuum head further comprising a pair of brackets spaced apart and connected to the rear side of the vacuum head on either side of the suction hose port, each vacuum head bracket comprising a slot, the assembly further comprising a secondary head for accommodating an electrostatic cloth, the secondary head comprising a pair of spaced apart brackets, each bracket of the secondary head comprising a tongue, the brackets of the secondary head being configured so the tongue of one of the secondary head brackets can be slidably received in the slot of one of the vacuum head brackets and the tongue of the other secondary head bracket can be slidably received in the slot of the other vacuum head bracket, and the secondary head brackets each further comprising a latch to secure the secondary head brackets to the vacuum head brackets when the tongues of the secondary head bracket are received in the slots of the vacuum head brackets.

* * * * *